US005372706A

United States Patent [19]

Buchanan et al.

[11] Patent Number: 5,372,706

[45] Date of Patent: Dec. 13, 1994

[54] FCC REGENERATION PROCESS WITH LOW $NO_x$ CO BOILER

[75] Inventors: J. Scott Buchanan, Mercerville, N.J.; David L. Johnson, Glen Mills, Pa.

[73] Assignee: Mobil Oil Corporation, Fairfax, Va.

[21] Appl. No.: 24,067

[22] Filed: Mar. 1, 1993

[51] Int. Cl.[5] ..... C10G 11/00

[52] U.S. Cl. ..... 208/113; 423/235; 423/236; 423/237; 502/38; 502/41

[58] Field of Search ..... 208/113; 423/235, 235 D, 423/236, 237; 502/38, 41

[56] References Cited

U.S. PATENT DOCUMENTS

| | | | |
|---|---|---|---|
| 3,867,507 | 2/1975 | Myerson | 423/235 D |
| 3,873,671 | 3/1975 | Reed et al. | 423/235 D |
| 3,970,743 | 7/1976 | Beavon | 423/574.1 |
| 3,987,154 | 10/1976 | Lagas | 423/574.1 |
| 4,117,075 | 9/1978 | Sano | 423/235 D |
| 4,244,325 | 1/1981 | Hart et al. | 423/235 D |
| 4,405,587 | 9/1983 | McGill et al. | 423/235 |
| 4,519,993 | 5/1985 | McGill et al. | 423/235 |
| 5,240,690 | 8/1993 | Tang et al. | 208/113 |

OTHER PUBLICATIONS

Lyon, R. K., Int. J. Chem. Kinet., 3, 315, 1976.

*Primary Examiner*—Helen M. S. Sneed
*Assistant Examiner*—Walter D. Griffin
*Attorney, Agent, or Firm*—Alexander J. McKillop; Malcolm D. Keen; Richard D. Stone

[57] ABSTRACT

Oxides of nitrogen ($NO_x$) emissions from an FCC regenerator are reduced by operating the regenerator in partial CO burn mode and adding substoichiometric, or just stoichiometric air to the flue gas. Much CO and most $NO_x$ and $NO_x$ precursors are thermally converted at 2000°-2900° F., then the gas is cooled below about 1800° F. and burning of CO completed.

19 Claims, 4 Drawing Sheets

FLUE GAS
336
AIR
341
FUEL GAS
351
AIR
341
FLUE GAS
336
REFRACTORY LINED
HEAT REMOVAL
ADDED SECTION
SECONDARY AIR
342
310
305
2700°F
314
325
315
1600°F
335
SECONDARY AIR
342
350
330
330
340
345
TO STACK
346
365
355
ECONOMIZER
CONVECTIVE BOILER SECTION
RADIANT SECTION

FCC REGENERATION PROCESS WITH LOW $NO_x$ CO BOILER

BACKGROUND OF THE INVENTION

1. FIELD OF THE INVENTION

The invention relates to regeneration of spent catalyst from an FCC unit.

2. DESCRIPTION OF RELATED ART $NO_x$, or oxides of nitrogen, in flue gas streams from FCC regenerators is a pervasive problem. FCC units process heavy feeds containing nitrogen compounds, and much of this material is eventually converted into $NO_x$ emissions, either in the FCC regenerator (if operated in full CO burn mode) or in a downstream CO boiler (if operated in partial CO burn mode). Thus all FCC units processing nitrogen containing feeds can have a $NO_x$ emissions problem due to catalyst regeneration, but the type of regeneration employed (full or partial CO burn mode) will determine whether $NO_x$ emissions appear sooner (regenerator flue gas) or later (CO boiler).

Although there may be some nitrogen fixation, or conversion of nitrogen in regenerator air to $NO_x$, most of the $NO_x$ emissions are believed to come from oxidation of nitrogen compounds in the feed.

Several ways have been developed to deal with the problem.

1. Feed hydrotreating, to keep $NO_x$ precursors from the FCC unit.
2. Segregated cracking of fresh feed.
3. Process approaches reducing $NO_x$ formation in complete CO burn mode via regenerator modifications.
4. Catalytic approaches, using a catalyst or additive which is compatible with the FCC reactor, which suppress $NO_x$ formation or catalyze its reduction in a regenerator in complete CO burn mode.
5. Stack gas cleanup isolated from the FCC process.

The FCC process will be briefly reviewed, followed by a review of the state of the art in reducing $NO_x$ emissions. In addition, some of the factors forcing FCC operators to process worse feeds (with more nitrogen compounds) in hotter regenerators (which tends to increase $NO_x$) in an ever more restrictive legislative environment will be discussed.

FCC PROCESS

Catalytic cracking of hydrocarbons is carried out in the absence of externally added H2, in contrast to hydrocracking, in which H2 is added during the cracking step. An inventory of particulate catalyst continuously cycles between a cracking reactor and a catalyst regenerator. In FCC, hydrocarbon feed contacts catalyst in a reactor at 425°–600° C., usually 460°–560° C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen-containing gas, usually air. Coke burns off, restoring catalyst activity and simultaneously heating the catalyst to, e.g., 500°–900° C., usually 600°–750° C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts are believed to work best when the amount of coke on the catalyst after regeneration is low.

Two types of FCC regenerators are now commonly used, the high efficiency regenerator and the bubbling bed type.

The high efficiency regenerator mixes recycled regenerated catalyst with spent catalyst, burns much of the coke from spent catalyst in a fast fluidized bed coke combustor, then discharges catalyst and flue gas up a dilute phase transport riser where some additional coke combustion occurs, and where most of the CO is afterburned to $CO_2$. These regenerators are designed for complete CO combustion, and usually produce clean burned catalyst, and flue gas will very little CO, and modest amounts of $NO_x$.

The bubbling bed regenerator maintains the catalyst as a bubbling fluidized bed, to which spent catalyst is added and from which regenerated catalyst is removed. These regenerators usually require more catalyst inventory in the regenerator, because gas/catalyst contacting is not so efficient in a bubbling fluidized bed as in a fast fluidized bed.

Many bubbling bed regenerators operate in complete CO combustion mode, i.e., the mole ratio of $CO_2/CO$ is at least 10. Refiners try to burn CO completely within the catalyst regenerator to conserve heat and to minimize air pollution.

Among the ways suggested to decrease the amount of carbon on regenerated catalyst and to burn CO in the regenerator is to add a CO combustion promoter metal to the catalyst or to the regenerator.

Metals have been added as an integral component of the cracking catalyst and as a component of a discrete particulate additive, in which the active metal is associated with a support other than the catalyst. U.S. Pat. No. 2,647,860 proposed adding 0.1 to 1 weight percent chromic oxide to a cracking catalyst to promote combustion of CO. U.S. Pat. No. 3,808,121, taught using large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory. This approach is so successful that most FCC units use Pt CO combustion promoter. This reduces CO emissions, but usually increases nitrogen oxides the ($NO_x$) content of the regenerator flue gas.

It is difficult in a catalyst regenerator to burn completely coke and CO in the regenerator without increasing the $NO_x$ content of the regenerator flue gas. Many jurisdictions have passed legislation restricting the amount of $NO_x$ that can be in a flue gas stream discharged to the atmosphere. In response to environmental concerns, much effort has been spent on finding ways to reduce $NO_x$ emissions.

The $NO_x$ problem is most acute in bubbling dense bed regenerators, perhaps due to localized high oxygen concentrations in the large bubbles of regeneration air. Even the high efficiency regenerators, with better catalyst/gas contacting, produce significant amounts of $NO_x$, though usually only about 50–75% of the $NO_x$ produced in a bubbling dense bed regenerator cracking a similar feed.

Much of the discussion following is generic to any type of regenerator while much is specific to bubbling dense bed regenerators, which here the most severe $NO_x$ problems.

FEED HYDROTREATING

Some refiners hydrotreat feed. This is usually done more to meet sulfur specifications in various cracked products, or a $SO_x$ limitation in regenerator flue gas, rather than a $NO_x$limitation. Hydrotreating will reduce to some extent the nitrogen compounds in FCC feed, and this will reduce $NO_x$emissions from the regenerator.

SEGREGATED FEED CRACKING

U.S. Pat. No. 4,985,133, Sapre et al, incorporated by reference, taught that refiners processing multiple feeds could reduce $NO_x$emissions, and improve performance in the cracking reactor, by keeping high and low nitrogen feeds segregated, and adding them to different elevations in the FCC riser.

PROCESS APPROACHES TO $NO_x$ CONTROL

Process modifications are suggested in U.S. Pat. No. 4,413,573 and 4,325,833, both directed to two-and three-stage FCC regenerators, which reduce $NO_x$ emissions.

U.S. Pat. No. 4,313,848 teaches countercurrent regeneration of spent FCC catalysts, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

U.S. Pat. No. 4,542,114 taught minimizing the volume of flue gas by using oxygen rather than air in the FCC regenerator, with consequent reduction in the amount of flue gas produced.

In Green et al, U.S. Pat. No. 4,828,680, incorporated by reference, $NO_x$ emissions from an FCC unit were reduced by adding carbonaceous particles such as sponge coke or coal into the circulating inventory of cracking catalyst. The carbonaceous particles performed selectively absorbed metal contaminants in the feed and also reduced $NO_x$ emissions. Many refiners are reluctant to add coal or coke to their FCC units, and such materials also burn, and increase the heat release in the regenerator. Most refiners would prefer to reduce, rather than increase, heat release in their regenerators.

DENOX WITH COKE

U.S. Pat. No. 4,991,521, Green and Yan, showed that a regenerator could be designed so coke on spent FCC catalyst could be used to reduce $NO_x$ emissions from an FCC regenerator. The patent shows a two stage FCC regenerator, wherein flue gas from a second stage of regeneration contacted coked catalyst. Although effective at reducing $NO_x$ emissions, this approach cannot be used in most existing regenerators.

DENOX WITH REDUCING ATMOSPHERES

Another process approach to reducing $NO_x$ emissions from FCC regenerators is to create a reducing atmosphere in some portion of the regenerator by segregating the CO combustion promoter. Reduction of $NO_x$ emissions in FCC regenerators was achieved in U.S. Pat. No. 4,812,430 and 4,812,431 by using a conventional CO combustion promoter (Pt) on an unconventional support which permitted the support to segregate in the regenerator. Use of large, hollow, floating spheres gave a sharp segregation of CO combustion promoter in the regenerator. Disposing the CO combustion promoter on fines, and allowing these fines to segregate near the top of a dense bed, or to be selectively recycled into the dilute phase above a dense bed, was another way to segregate the CO combustion promoter.

CATALYTIC APPROACHES TO $NO_x$ CONTROL

The work that follows is generally directed at special catalysts which promote CO afterburning, but do not promote formation of much $NO_x$.

U.S. Pat. No. 4,300,997 and U.S. Pat. No. 4,350,615, are directed to use of Pd-Ru CO-combustion promoter. The bi-metallic CO combustion promoter is reported to convert CO to $CO_2$, while minimizing formation of $NO_x$.

U.S. Pat. No. 4,199,435 suggests steam treating conventional CO combustion promoter to decrease $NO_x$ formation without impairing too much the CO combustion activity of the promoter.

U. S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative the patentee suggests deactivating it in place, by adding lead, antimony, etc.

U.S. Pat. No. 5,002,654, Chin, incorporated by reference, taught the effectiveness of a zinc based additive in reducing $NO_x$. Relatively small amounts of zinc oxides impregnated on a separate support having little or no cracking activity produced an additive which could circulate with the FCC equilibrium catalyst and reduce $NO_x$ incorporated by reference , taught the U. S. Pat. No. 4,988,432 Chin incorporated by reference, taught the effectiveness of an antimony based additive at reducing $NO_x$.

Many refiners are reluctant to add more metals to their FCC catalyst out of environment concerns. Some additives, such as zinc, may vaporize under conditions experienced in some FCC units. Adding, antimony to FCC catalyst may make disposal of spent catalyst more difficult.

Such additives also add to the cost of the FCC process, may dilute the FCC equilibrium catalyst, and may not be as effective as desired.

In U.S. No. Pat. 5,021,144, Altrichter, minimized $NO_x$ emissions downstream of a CO boiler by operating the FCC regenerator in partial CO burn mode with at least three times the amount of Pt needed to prevent afterburning. Adding Pt to the FCC catalyst reduced $NO_x$ in the CO boiler stack gas.

Considerable effort has been spent on downstream treatment of FCC flue gas. This area will be briefly reviewed.

STACK GAS TREATMENT

It is known to react $NO_x$ in flue gas with $NH_3$. $NH_3$ is a selective reducing agent, which does not react rapidly with the excess oxygen which may be present in the flue gas. Two types of $NH_3$ process have evolved, thermal and catalytic.

Thermal processes, such as the Exxon Thermal $DeNO_x$ process, operate as homogeneous gas-phase processes at around 1550°–1900° F. More details of such a process are disclosed by Lyon, R. K., Int. J. Chem. Kinet., 3, 315, 1976, incorporated by reference.

Catalytic systems have been developed which operate at lower temperatures, typically at 300°–850° F. These temperatures are typical of flue gas streams. Unfortunately, the catalysts used in these processes are readily fouled, or the process lines plugged, by catalyst fines which are an integral part of FCC regenerated flue gas.

U.S. Pat. No. 4,521,389 and 4,434,147 teach adding $NH_3$ to flue gas to reduce catalytically $NO_x$ in flue gas to nitrogen.

U. S. Pat. No. 5,015,362, Chin incorporated by reference, taught contacting flue gas with sponge coke or coal, and a catalyst promoting reduction of $NO_x$ in the presence of coke or coal.

None of the approaches described is the perfect solution.

feed pretreatment is expensive, and can usually only be justified for sulfur removal. Segregated feed cracking helps significantly, but requires segregated high and low nitrogen feeds.

Process approaches, such as multi-stage or countercurrent regenerates, reduce $NO_x$ emissions but require extensive rebuilding of the FCC regenerator.

Various catalytic approaches, e.g., adding lead or antimony, to degrade the efficiency of the Pt function may help some but not meet the ever more stringent $NO_x$ emissions limits set by local governing bodies.

Stack gas cleanup methods are powerful, but the capital and operating costs are high.

We realized that a difficult situation, operating an FCC regenerator to clean the catalyst without fouling the atmosphere, was just going to get worse. FCC operators are forced to crack worse crudes because light sweet crudes cost too much or are not available. These worse feeds have more $NO_x$ precursors in them and are heavier, with large amounts of CCR or asphaltness which must be burned in the regenerator. More feed nitrogen means more $NO_x$ emissions. Heavier feeds also translate into higher regenerator temperatures which increase $NO_x$ emissions from regenerators operating in complete CO combustion mode. While some of the heat release can be deferred by shifting CO combustion to a CO boiler, such partial CO combustion in the regenerator usually produces slightly more $NO_x$ emissions from a downstream CO boiler than would be found in flue gas from the same regenerator operating in complete CO burn mode. Compounding the problem, local laws put ever more stringent limits on $NO_x$ emissions. Worse feeds, the need to operate in partial CO combustion mode in the regenerator, and tighter $NO_x$ limits combine to create conditions which could shutdown many FCC units, or require installation of expensive pre- or post- treatment steps on feed or flue gas respectively. Simple fixes, such as operating with a CO boiler and adding ammonia or urea to reduce $NO_x$, achieve a limited reduction in $NO_x$ emissions, but require handling extra chemicals and create the chance of ammonia or urea emissions.

We did not like any of these approaches, but discovered in some of these approaches, and in some unrelated art., on $H_2S$ conversion, a new approach. Claus units convert $H_2S$ to elemental sulfur, and they are not related to the FCC process. They burn $SO_2$ with $H_2S$ at close to stoichiometric ratios to produce elemental sulfur, at temperatures of 2500° to 3000° F. Several Claus workers reported on the fate of $NH_3$, and this work is worth a brief review.

U.S. Pat. No. 3,987,154, Lagas, which is incorporated by reference had 2 examples showing the fate of $NH_3$. In one, 2.5% $NH_3$ was reduced to 6–22 ppm. $NH_3$, while in the other 3.7% $NH_3$ was reduced to 10–40 ppm $NH_3$. The residence time was around 0.8 seconds, and the temperature was not specified.

U.S. Pat. No. 3,970,743, Beavon, which is incorporated by reference, taught operating the first chamber at 2500°–3000° F. He reported that $NH_3$ was stable at 1900°–2300° F. In runs at higher temperatures with excess $O_2$, and even with oxygen lean condition, he could destroy $NH_3$. The residence times were 0.2 –1.0 second, and were reported to "essentially completely" destroy N-compounds.

We realized we could run a regenerator in partial CO burn mode, and convert the CO and $NO_x$ in downstream processing units to less noxious species, without adding ammonia or urea, and without a catalyst, provided we did it in stages, and with special operating conditions at each stage.

We discovered that CO oxidation could convert $NO_x$, if unusually high temperature were used and no more than stoichiometric air was present. We found that higher temperatures, far exceeding any that had ever been used in a conventional CO boiler, could destroy $NO_x$ and $NO_x$ precursors during CO combustion with sub-stoichiometric, or just stoichiometric air. We then cooled the gas, which had a very low fuel value at this point, and added more air to burn the remaining CO, with an unusually low flame temperature, and little $NO_x$ formation during this limited stage of CO combustion.

BRIEF SUMMARY OF THE OF THE INVENTION

Accordingly the present invention provides a process for the catalytic cracking of a nitrogen containing hydrocarbon feed to lighter products comprising cracking said feed by contact with a supply of regenerated cracking catalyst in a fluidized catalytic cracking (FCC) reactor means operating at catalytic cracking conditions to produce a mixture of cracked products and spent cracking catalyst containing coke and nitrogen compounds; separating cracked products from said spent cracking catalyst to produce a cracked product vapor phase which is charged to a fractionation means and a spent catalyst phase; stripping spent catalyst in a stripping means to produce stripped, spent catalyst containing coke and nitrogen compounds; regenerating stripped, spent catalyst in a catalyst regeneration means by contact with oxygen or an oxygen-containing regeneration gas at catalyst regeneration conditions to produce regenerated catalyst and a flue gas stream containing less than 1.0 mole % oxygen, at least 1.0 mole % CO; and $NO_x$ and $NO_x$ precursors; recovering from said catalyst regeneration means regenerated catalyst and recycling same to said cracking reactor; adding oxygen or an oxygen containing gas to said regenerator flue gas in an amount sufficient to convert from about 50 to 100% of the CO in said flue gas to $CO_2$ and form a flue gas and oxygen mixture; converting said $NO_x$ and $NO_x$ precursors in a $NO_x$ conversion zone operating at a $NO_x$and $NO_x$ percursors conversion conditions including a temperature above 2200° F. and a residence time sufficient to convert at least a majority of said $NO_x$ and $NO_x$ precursors to nitrogen in said $NO_x$ conversion zone and convert at least a majority but not all of said CO to $CO_2$ in said zone to produce to a $NO_x$ and $NO_x$ precursor depleted gas mixture having a temperature above 2200° F. and containing CO; cooling said depleted mixture below 1800° F. to produce a cooled flue gas stream containing CO; adding oxygen or an oxygen containing gas to said cooled flue gas stream in an amount sufficient to convert at least 100% of the CO contained in said cooled flue gas stream to $CO_2$ and converting CO to $CO_2$ in a CO conversion zone operating at a temperature below 1800° F. to produce a flue gas stream which may be discharged to the atmosphere.

In another embodiment, the present invention provides a process for the catalytic cracking of a nitrogen containing hydrocarbon feed to lighter products comprising: cracking said feed by contact with a supply of regenerated cracking catalyst in a fluidized catalytic cracking (FCC) reactor means operating at catalytic cracking conditions to produce a mixture of cracked products and spent cracking catalyst containing coke and nitrogen compounds; separating cracked products from said spent cracking catalyst to produce a cracked product vapor phase which is charged to a fractionation means and a spent catalyst phase; stripping spent catalyst in a stripping means to produce stripped, spent catalyst containing coke and nitrogen compounds; regenerating stripped, spent catalyst in a catalyst regeneration means by contact with oxygen or an oxygen-containing regeneration gas at catalyst regeneration conditions to produce regenerated catalyst and an FCC regenerator flue gas stream containing less than 0.1 mole % oxygen, at least 3.0 mole % CO and $NO_x$ and $NO_x$ precursors including HCN in an amount so that when said regenerator flue gas is burned in a conventional CO boiler at 1400°-2000° F. in an oxidizing atmosphere it would produce a CO boiler flue gas containing more than 100 ppm volume $NO_x$; recovering from said catalyst regeneration means regenerated catalyst and recycling same to said cracking reactor; adding oxygen or an oxygen containing gas to said regenerator flue gas in an amount sufficient to convert from 60 to 100% of the CO in said flue gas to $CO_2$ and form a flue gas and oxygen mixture; converting said $NO_x$ and $NO_x$ precursors in A $NO_x$ conversion zone operating at a $NO_x$ and $NO_x$ precursors conversion conditions including a temperature above 2400 ° F. and a residence time sufficient to convert at least a majority of said $NO_x$ and $NO_x$ precursors to nitrogen in said $NO_x$ conversion zone and convert at least a majority but not all of said CO to $CO_2$ in said zone to produce a $NO_x$ and $NO_x$ precursor depleted gas mixture having a temperature above 2400° F. and containing CO; cooling said depleted mixture to a temperature below 1800° F. to produce a cooled flue gas stream containing CO; adding oxygen or an oxygen containing gas to said cooled flue gas stream in an amount sufficient to convert at least 100% of the CO contained in said cooled flue gas stream to $CO_2$ and converting CO to $CO_2$in a CO conversion zone operating at a temperature below 1800° F. and less than 100 ppmv CO which may be discharged to the atmosphere.

DETAILED DESCRIPTION

Figure 1:
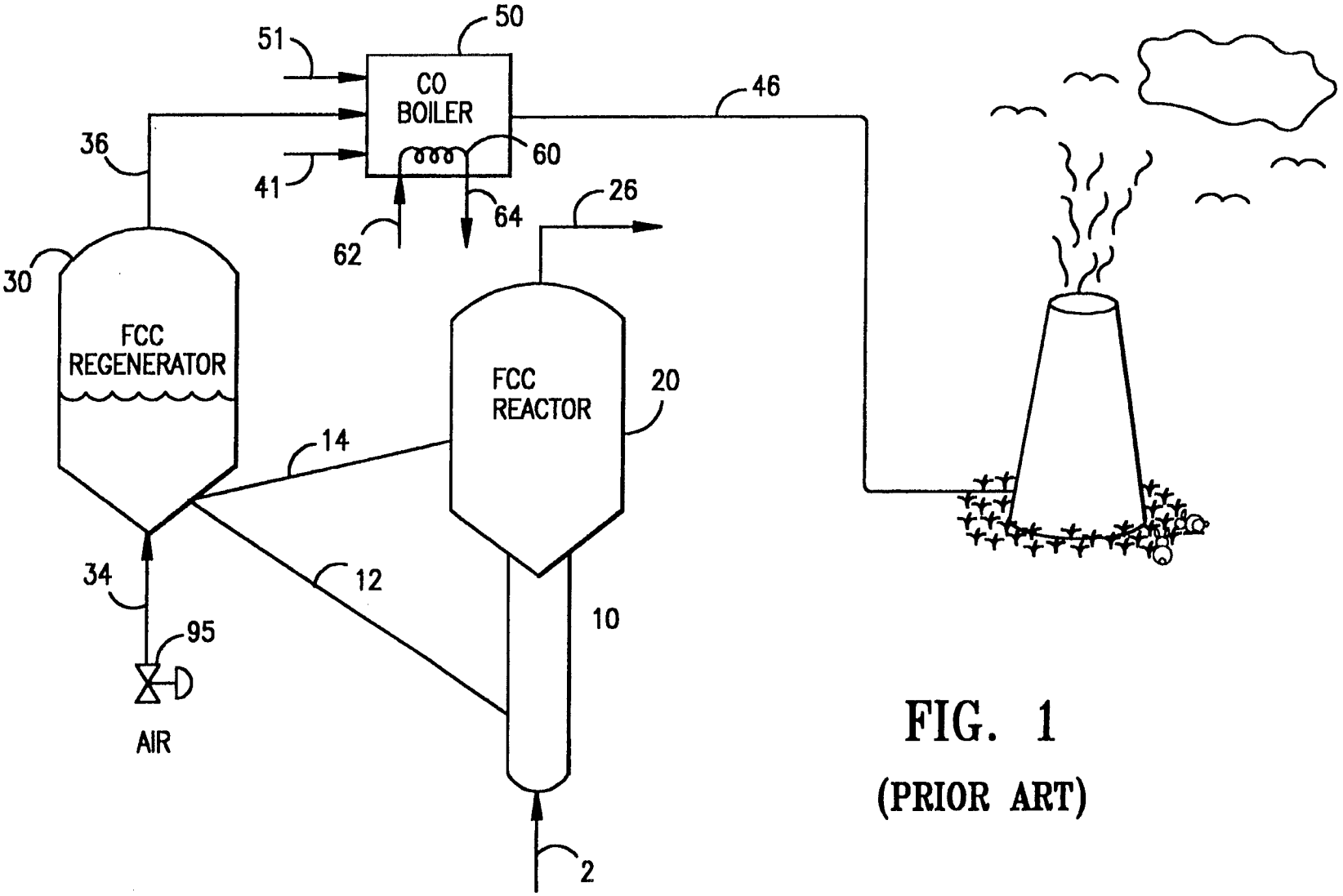
FIG. 1 (PRIOR ART)
FIG. 1 (Prior Art) shows a conventional FCC regenerator with CO boiler with CO boiler.

The process of the present invention is an integral part of the catalytic cracking process. The essential elements of this process will be briefly reviewed with a review of FIG. 1.

A heavy, nitrogen containing feed is charged via line 2 to riser reactor 10. Hot regenerated catalyst removed from the regenerator via line 12 vaporizes fresh feed in the base of the riser reactor, and cracks the feed. Cracked products and spent catalyst are discharged into vessel 20, and separated. Spent catalyst is stripped in a stripping means not shown in the base of vessel 20, then stripped catalyst is charged via line 14 to regenerator 30. Cracked products are removed from vessel 20 via line 26 and charged to an FCC main column, not shown.

Spent catalyst is maintained as a bubbling, dense phase fluidized bed in vessel 30. Regeneration gas, almost always air, sometimes supplemented with oxygen, is added via line 34 to the base of the regenerator. Air flow is controlled by flow control valve 95. Regenerated catalyst is removed via line 12 and recycled to the base of the riser reactor.

Flue gas is removed from the regenerator via line 36 and charged to CO boiler 50. Combustion air is added line 41, and additional fuel (if needed) added via line 51. The CO in the regenerator flue gas burns, releasing heat which is recovered using heat exchange means 60. In most refiners, boiler feed water is added via line 62 to heat exchange tubes 60 and high pressure steam recovered via line 64. The flue gas is discharged from the CO boiler via line 46 and charged to stack 98 for discharge to the atmosphere.

The process and equipment recited above are those used in many conventional FCC regenerators. Many FCC regenerators use such bubbling bed regenerators, which have more severe $NO_x$emissions characteristics than high efficiency regenerators. Both bubbling fluid bed and fast fluid bed regenerators can run in partial CO burn mode and produce large amounts of $NO_x$ in a downstream CO boiler.

While the process of the present invention can be practiced in a conventional refinery, if the CO boiler can tolerate the high temperatures required, most refiners will prefer to install a separate $NO_x$ conversion stage upstream of, or as a first stage of, a move conventional CO boiler. CO boilers will be reviewed in more detailed below, starting with a more detailed description of a conventional CO boiler (FIG. 2), a preferred CO boiler for use in the present invention (FIG. 3) and ending with some discussion of a preferred control method (FIG. 4) .

Figure 2:
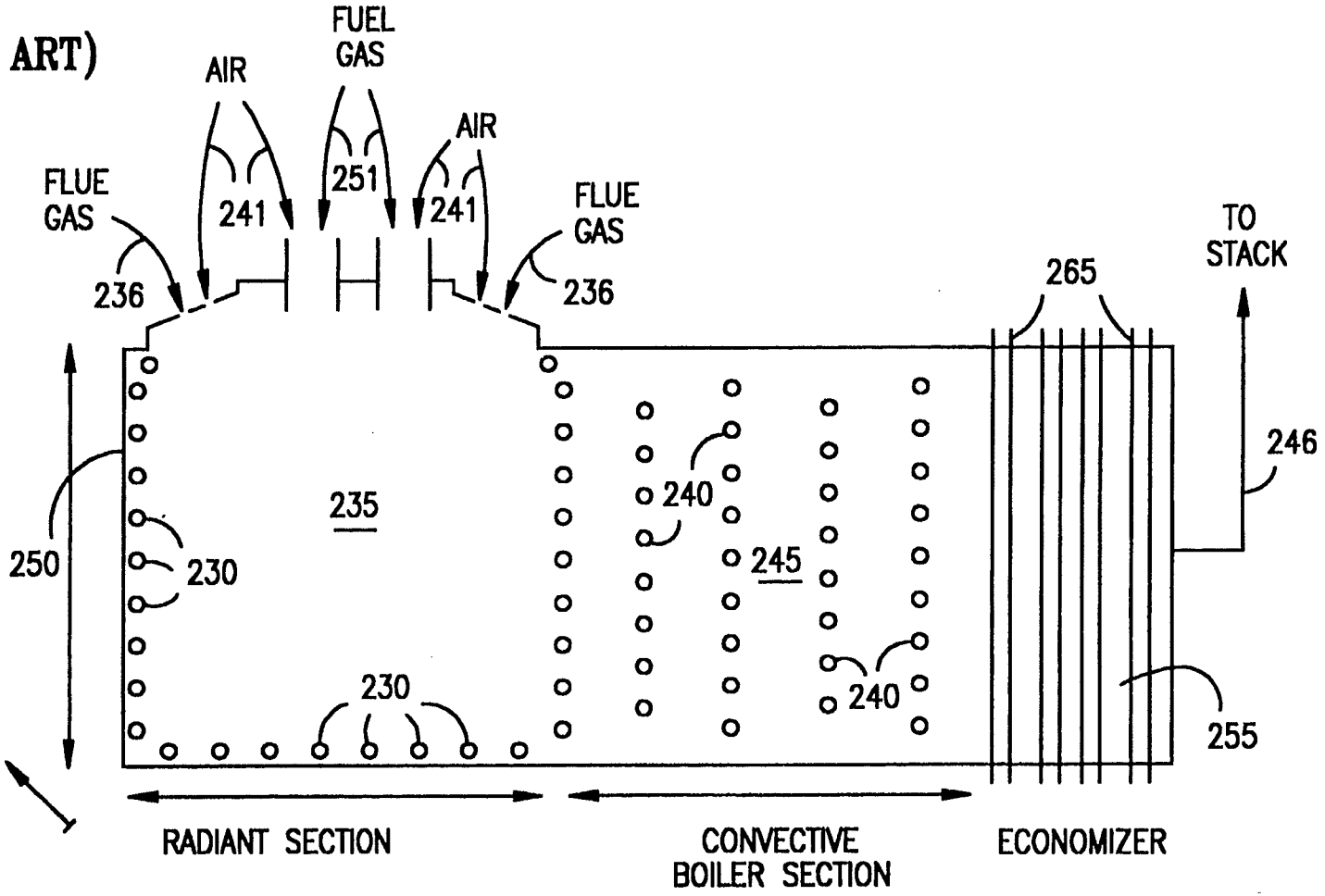
FIG. 2 (PRIOR ART)
FIG. 2 (Prior Art) shows a conventional CO boiler.

FIG. 2 (prior art) shows a typical FCC CO boiler 250, drawn only roughly to scale. CO containing flue gas from the FCC regenerator enters via lines 236, while air is charged via a plurality of air inlet means 241 and fuel gas inlet means 251. These gases mix and burn in the radiant section 235 of the CO boiler. Heat is recovered via a plurality of heat exchange tubes 230. Additional heat is recovered in the convection section 245, downstream of the radiant section. Finally flue gasses pass through the economizer section 255 wherein additional heat is recovered from the flowing gas stream via heat exchange tubes 265. The cooled gas is discharged via line 246 to the flue gas stack. While the conventional CO boiler shown in FIG. 2 can be used in some refineries to practice the process of the present invention, most CO boilers will require some modifications, to meet metallurgical constraints and to improve $NO_x$ precursor conventional.

Figure 3:
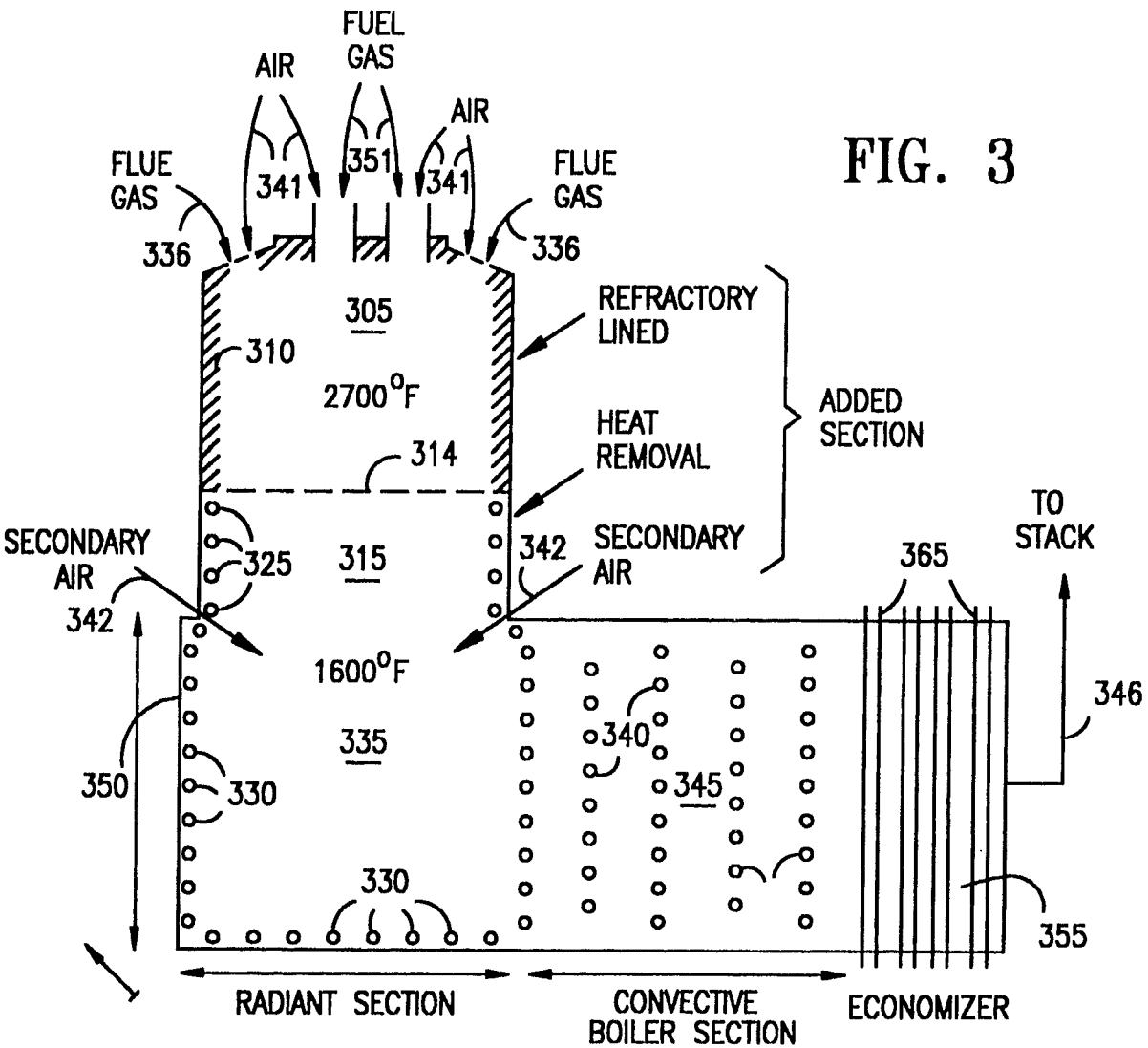
FIG. 3 (Invention) shows a modified CO boiler, with a high temperature, refractory lined $NO_x$ precursor conversion section.
Figure 4:
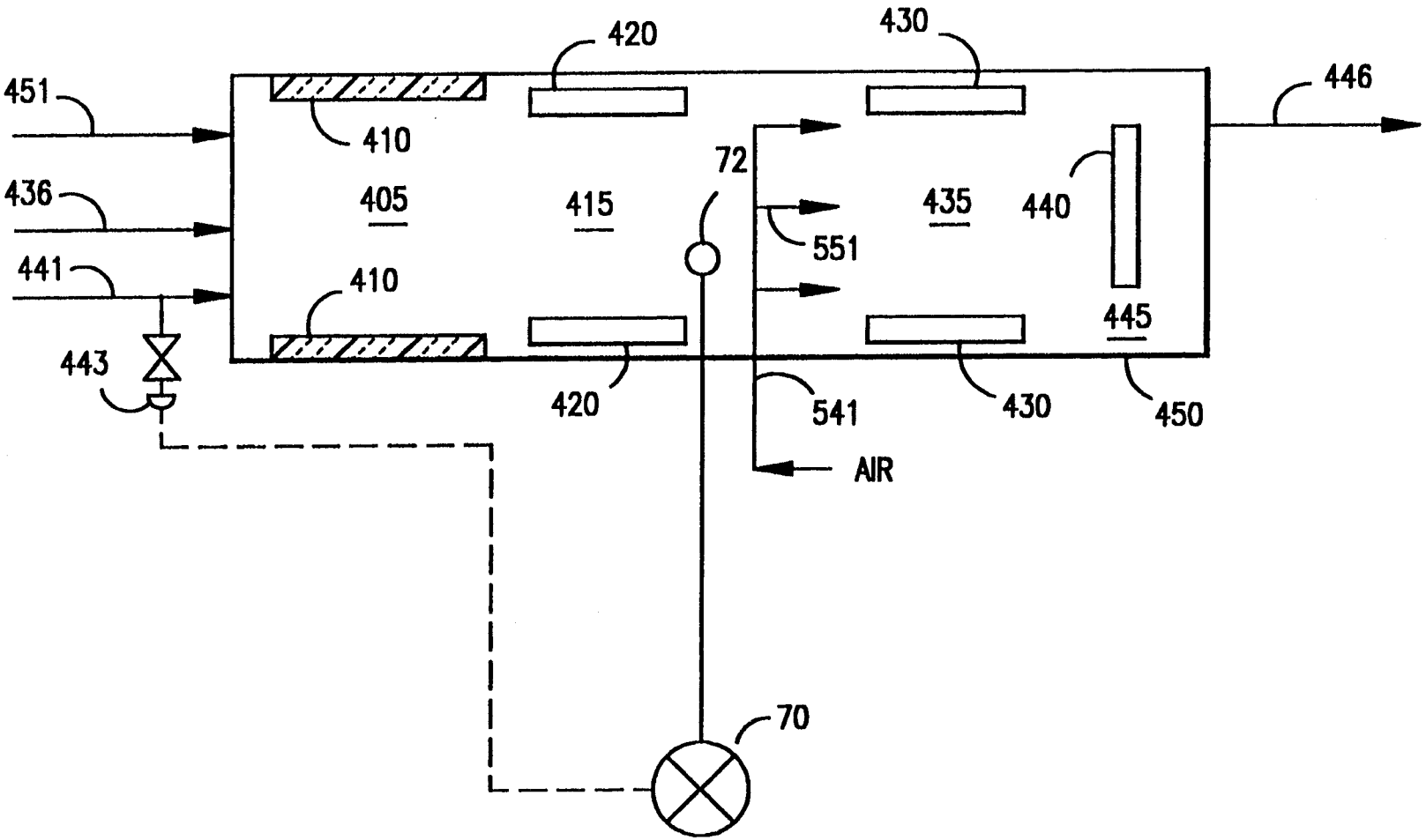
FIG. 4 (Invention) shows a simplified schematic view of a CO boiler with a preferred control system.

FIG. 3 (Invention) shows a CO boiler 350 with a $NO_x$ precursor conversion section 305 in an upstream portion. Flue gas from the FCC regenerator is added via lines 336 while air is charged via a plurality of air inlet means 341 and fuel gas inlet means 351. The FCC regenerator will be run to produce large amounts of CO and/or large amounts of fuel gas will be added. These gases mix and burn in the $NO_x$ conversion region 305, which operates at temperatures higher than those used in any FCC CO boiler, preferably at about 2700° F. Usually it will be necessary to line the CO boiler with a suitable refractory material 310, and provide a checker wall 314, which may be made of brick or other suitable material, to ensure adiabatic combustion in region 301. This high temperature operation converts most of the $NO_x$ precursors, but not necessarily all of the CO. More combustion air will usually be needed to burn the remaining CO, but we do not want to burn CO at the high temperatures of region 305, and therefore cool the gas with a heat removal means such as heat exchange tubes 325 in cooling region 315.

Secondary air is added via air addition means 342 to the CO combustion region 335 roughly corresponding to the radiant section of the prior art CO boiler. Heat is removed via a plurality of tubes 330, and gas then passes through the convective boiler section 345. Tubes 340 remove heat from the gas primarily by convective heat transfer, and the gas then passes into economizer region 355 where additional heat is removed. Gas is discharged to the stack via line 346.

FIG. 4 shows a preferred control method. FCC regenerator flue gas in line 436 enters the NO converter and CO boiler 450. Additional fuel such as fuel gas, if necessary, is added via line 451, while air or oxygen enriched air is added via line 441. The CO in the flue gas burns to form a high temperature gas mixture, with a temperature of at least 2200° F. and preferably above 2400 F. This mixture burns or is present in a high temperature zone 405, containing refractory insulation 410. Heat is removed from this gas in intermediate cooling region 415 by heat removal means 420, which will usually be a heat exchange tubes, or a dimpled jacket heat exchanger or the like. The cooled gas is then charged to a section which in hardware and metallurgy resembles the conventional CO boiler. Additional air will usually be added via line 541 and distributed via a plurality of nozzles 551. Heat is removed by radiant heat exchange means 430 lining region 435 and then by convective heat exchange means 440 in convective section 445. Flue gas is discharged via line 446 to the stack, not shown.

The air addition rate via line 441 is preferably controlled to provide just stoichiometric or substoichiometric air for the high temperature region. One way this can be done is by analyzing the composition and volume of all streams entering the device. A preferred and robust control method is shown in FIG. 4, with an oxygen sensor 72 and analyzer controller 70 operatively connected with flow control valve 443 on air line 441.

An equivalent control method is to keep the air flow in line 441 constant, and use the signal from controller 70 to adjust fuel gas flow.

More details will now be provided about various conventional and unconventional parts of our process.

FCC FEED

Any conventional FCC feed can be used. The process of the present invention is useful for processing nitrogenous charge stocks, those containing more than 500 ppm total nitrogen compounds, and especially useful in processing stocks containing very high levels of nitrogen compounds, such as those with more than 1000 wt ppm total nitrogen compounds.

The feeds may range from the typical, such as petroleum distillates or residual stocks, either virgin or partially refined, to the atypical, such as coal oils and shale oils. The feed frequently contains recycled hydrocarbons, light and heavy cycle oils which have already been subjected to cracking.

Preferred feeds are gas oils, vacuum gas oils, atmospheric resids, and vacuum resids. The invention is most useful with feeds having an initial boiling point above about 650° F.

FCC CATALYST

Commercially available FCC catalysts may be used. The catalyst preferably contains large amounts of large pore zeolite for maximum effectiveness, but such catalysts are readily available. The process will work with amorphous catalyst, but few modern FCC units use amorphous catalyst.

Preferred catalysts for use herein will usually contain at least 10 wt % large pore zeolite in a porous refractory matrix such as silica-alumina, clay, or the like. The zeolite content is preferably much higher than this, and should usually be at least 20 wt % large pore zeolite, with optimum results achieved when unusually large amounts of large pore zeolite, in excess of 30 wt %, are present in the catalyst. For best results the catalyst should contain from 30 to 60 wt % large pore zeolite.

All zeolite contents discussed herein refer to the zeolite content of the makeup catalyst, rather than the zeolite content of the equilibrium catalyst, or E-Cat. Much crystallinity is lost in the weeks and months that the catalyst spends in the harsh, steam filled environment of modern FCC regenerators, so the equilibrium catalyst will contain a much lower zeolite content by classical analytic methods. Most refiners usually refer to the zeolite content of their makeup catalyst, and the MAT (Modified Activity Test) or FAI (Fluidized Activity Index) of their equilibrium catalyst, and this specification follows this naming convention.

Conventional zeolites such as X and Y zeolites, or aluminum deficient forms of these zeolites such as dealuminized Y (DEAL Y), ultrastable Y (USY) and ultrahydrophobic Y (UHP Y) may be used as the large pore cracking catalyst. The zeolites may be stabilized with Rare Earths, e.g.,.0.1 to 10 wt % RE.

Relatively high silica zeolite containing catalysts are preferred. Catalysts containing 20–60% USY or rare earth USY (REUSY) are especially preferred.

The catalyst inventory may also contain one or more additives, either present as separate additive particles, or mixed in with each particle of the cracking catalyst. Additives can be added to enhance octane (medium pore size zeolites, sometimes called shape selective zeolites, i.e., those having a Constraint Index of 1–12, and typified by ZSM-5, and other materials having a similar crystal structure).

The FCC catalyst composition, per se, forms no part of the present invention.

CO COMBUSTION PROMOTER

Use of a Pt CO combustion promoter is neither essential nor preferred for the practice of the present invention, however, some may be present. These materials are well-known.

SOx ADDITIVES

Additives may be used to adsorb SOx. These are believed to be primarily various forms of alumina, rare-earth oxides, and alkaline earth oxides, containing minor amounts of Pt, on the order of 0.1 to 2 ppm Pt. Additives for removal of SOx are available from several catalyst suppliers, such as Davison's "R" or Katalistiks International, Inc.'s "DESOX."

The effectiveness of these additives will be degraded some because the regenerator will be very deep in partial CO combustion mode. Some benefit will be seen, but not as much as if the regenerator were in complete CO burn mode.

FCC REACTOR CONDITIONS

The reactor operation will usually be conventional all riser cracking FCC, such as disclosed in U.S. Pat. No. 4,421,636, incorporated by reference. Typical riser cracking reaction conditions include catalyst/oil ratios of 0.5:1 to 15:1 and preferably 3:1 to 8:1, and a catalyst contact time of 0.1–50 seconds, and preferably 0.5 to 10 seconds, and most preferably about 0.75 to 5 seconds, and riser top temperatures of 900° to about 1100°, preferably 950° to 1050° F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A closed cyclone system is disclosed in U.S. Pat. No. 4,502,947 to Haddad et al, incorporated by reference, and in various journal articles and is available from the M. W. Kellogg engineering company.

It is preferred but not essential, to strip rapidly the catalyst just as it exits the riser, and upstream of the conventional catalyst stripper. Stripper cyclones disclosed in U.S. Pat. No. 4,173,527, Schatz and Heffley, incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, incorporated by reference.

Conventional FCC steam stripping conditions can be used, with the spent catalyst having essentially the same temperature as the riser outlet, and with 0.5 to 5% stripping gas, preferably steam, added to strip spent catalyst.

The FCC reactor and stripper conditions, per se, can be conventional.

CATALYST REGENERATION

The process and apparatus of the present invention can use conventional bubbling dense bed FCC regenerators or high efficiency regenerators. Bubbling bed regenerators will be considered first. In these units much of the regeneration gas, usually it is air, passes through the bed in the form of bubbles. These pass through the bed, but contact it poorly.

These units operate with large amounts of catalyst, because the bubbling bed regenerators are not very efficient at burning coke, hence a large inventory and long residence time in the regenerator were needed to get clean burned catalyst.

The carbon on regenerated catalyst can be conventional, typically less than 0.3 wt % coke, and more preferably less than 0.15 wt % coke, and most preferably even less. By coke we mean not only carbon, but minor amounts of hydrogen associated with the coke, and perhaps even very minor amounts of unstripped heavy hydrocarbons which remain on catalyst. Expressed as wt % carbon, the numbers are essentially the same, but 5 to 10% less.

Although the carbon on regenerated catalyst can be the same as that produced by conventional FCC regenerators, the flue gas preferably contains large amounts of CO. Usually the flue gas will contain more than 1.0 mole % CO, and preferably more than 2 or 3 mole % CO, and most preferably more than 5 mole % CO. Many existing FCC regenerators, especially those designed to run with CO boilers, produce flue gas with 6 to perhaps 9 or 10 mole % CO. Expressed as $CO_2$:CO ratios, the flue gas preferably contains from about a 1:1 ratio to a 10:1 ratio, and most preferably from about 3:1 to 1:1. This minimizes heat release in the FCC regenerator, increases the coke burning capacity of the regenerator, and maximizes the fuel value of this gas. Preferably the FCC regenerator is run so that when stoichiometric or 90% of stoichiometric air is added to the regenerator flue gas the flame temperature will be at least 2200° F., and more preferably at least 2400° F.

Because the regenerator will be deep in partial CO burn, there will not usually be much free oxygen in the flue gas, almost always less than 1.0 mole %, and typically from 0.1 mole % to none. This is because any oxygen available will rapidly react to extinction at these conditions.

$NO_x$/CO CONVERSION ZONE

The $NO_x$/CO conversion zone operates in two distinct regions, a high temperature zone and a low temperature zone. The high temperature zone must remove most of the $NO_x$ or $NO_x$ precursors and inherently removes 80–90 +% of the CO present, although it does not have to remove this much CO. The low temperature zone must remove enough CO to meet local flue gas emissions limits. There is usually not much CO left in the stream at this point, so CO afterburning inherently forms very little $NO_x$. Each zone will be discussed in more detail below.

HIGH TEMPERATURE ZONE

This zone, region 305 in FIG. 3, and 405 in FIG. 4, must operate at a temperature above 2200° F., preferably above 2250° F., more preferably above 2300°. The zone is essentially free of catalyst. Optimum results will usually be achieved when the temperature is 2400° to 2900° F., with higher temperature operation possible but not preferred because of metallurgical limits and because many refractory linings start decomposing at temperatures above 3000°–3100° F. Temperature alone does not define this zone, adequate residence time must also be permitted to achieve the desired conversion of $NO_x$ and its precursors to nitrogen. Usually a residence of 0.1 to 10 seconds will suffice. Most units will operate with 0.5 to 5 seconds of gas residence time, and about 1 or 2 seconds of gas residence time is preferred. There is a trade-off between time and temperature, and higher temperatures permit successful operation with shorter residence times.

Preferably the outlet of the high temperature zone comprises a "checker wall" a porous barrier which allows gas to pass from the high temperature zone to the contiguous intermediate cooling zone, while retarding radiant heat loss from the high temperature zone. The use of a porous wall will also prevent gas recirculation from the cooling zone to the high temperature zone.

Use of a porous wall at the high temperature zone outlet facilitates several preferred methods of introducing gaseous reactants. Rapid and through mixing of gaseous reactants is very important. Two preferred ways of achieving rapid mixing are introducing the gases through a multiplicity of interspersed nozzles and tangential, high velocity injection. Introducing some or all of the gases at a velocity of 50 to 300 fps, in a direction tangential to an inside wall of the higher temperature chamber will create a swirling or cyclonic circulation pattern which promotes gas mixing.

INTERMEDIATE COOLING ZONE

The gas leaving the high temperature zone should be cooled before additional air is added to complete CO combustion. If CO combustion were completed with excess air at the high temperatures in the $NO_x$ conversion zone, then there would be a considerable amount of $NO_x$ formed during CO combustion, much of it due to nitrogen fixation.

Preferably heat transfer tubes or dimpled heat exchange surfaces line the walls downstream of the high temperature $NO_x$ conversion zone. This heat transfer can produce high pressure steam and cool the gas. Sufficient heat should be removed by radiant or convective heat exchange, so the gas leaving this zone has a temperature below 2000° F., preferably from 1400°–1900° F., and most preferably 1500°–1800° F. This is usually higher than the flue gas temperature from a conventional single stage regenerator, whether bubbling bed or high efficiency, operating in either full or partial CO burn mode.

CO CONVERSION ZONE

The low temperature, or CO conversion zone region 335 and 435 in FIGS. 3 and 4 is preferably contiguous with, and an extension of, the $NO_x$ conversion zone and intermediate cooler. It may also be a separate vessel, and in many refineries will be the old CO boiler. The temperature in the low temperature zone will usually be within about 100° F. of the gas leaving the intermediate cooler. The CO conversion zone temperature may range from 1400° to 2000° F., and preferably from 1500° to 1800° F.

The gas entering the CO conversion zone will typically have the following composition:

| | Suitable | Preferred | Optimum |
|---|---|---|---|
| $O_2$, mole % | LT 1% | LT 0.1% | 0 |
| CO, mole % | 0–10 | 0.1–8 | 0.5 |
| $NO_x$, ppmv | 0–100 | 0.1–50 | 0.5–10 |

Where $NO_x$ refers both to oxides of the nitrogen and nitrogen compounds such as $NH_3$ which oxidize to form $NO_x$, Enough air will be added to supply at least the amount required by stoichiometry to burn all the CO in the entering gas stream. Preferably modest amount of excess air is added to help drive the reaction to completion. Preferably there is rapid and thorough mixing of the added air. Thus enough air, or $O_2$, or $O_2$ enriched air will be added to produce a flue gas containing some free $O_2$. Typical flue gas streams leaving the low temperature section will have the following composition:

| | Suitable | Preferred | Optimum |
|---|---|---|---|
| $O_2$, mole % | 0–5 | 0.05–2 | 0.1–1 |
| CO, ppmv | LT 1000 | LT 500 | LT 100 |
| $NO_x$, ppmv | 0–100 | 0.1–50 | 0.5–10 |

Again $NO_x$ refers to oxides of nitrogen and its precursors. Ideally the $NO_x$ level will change very little, or increase a modest amount in the CO conversion zone. This low production of $NO_x$ can be attributed to several factors: the destruction of most of the $NO_x$ precursors upstream of the CO conversion zone, and the low flame temperatures associated with burning CO streams containing little CO.

CONTROL

Usually it will be preferred to monitor frequently or continuously the CO content of the regenerator flue gas and the free oxygen content just downstream of the high temperature zone. For safety, it will usually be beneficial to measure CO and $NO_x$ content of the flue gas stream being discharged to the stack, as well as the oxygen content. For reliability, we prefer a zirconia-based, solid-state oxygen activity analyzer for at least the high temperature service, e.g., sensor 72.

Careful control of the oxygen concentration is believed to be very important. It there is more than a stoichiometric amount of oxygen this may produce a lot of $NO_x$. If there is less oxygen present, an amount far below stoichiometric then it may be hard to drive $NH_3$ conversion to completion.

The high temperature zone should be sized large enough so the desired conversion of $NO_x$ can occur. The CO conversion is rapid at these conditions and additional CO conversion may take place downstream. $NO_x$ conversion will usually be limiting, and in most units about 1 second of vapor residence time in the high temperature zone and some portion of the high temperature heat recovery zone near exchangers 120 will be sufficient.

The intermediate flue gas product from the high temperature combustion zone may be a unique material. It can have less than 100 ppm $NO_x$, essentially no free oxygen or at most about 0.1 to 0.2 mole % $O_2$, less than 3 or 4 mole % CO, and a temperature above that of any conventional single stage FCC regenerator. Preferably it has less than 50 ppm $NO_x$, no free oxygen, less than 2% CO, and a temperature above 2200° F. In contrast, flue gas streams from conventional regenerators are always cooler, and always have more $NO_x$ or $NO_x$ precursors. Flue gas streams from conventional CO burners have excess oxygen, and much more $NO_x$.

The intermediate flue gas product has a great deal of thermal energy, because of its high temperature, but little fuel value. The CO remaining can be burned with modest amounts of air, without forming much $NO_x$, for two reasons. First, most $NO_x$ precursors were destroyed in the high temperature zone. Second, the low heating value of the flue gas produces low flame temperatures, so remaining $NO_x$ precursors will never see the high temperatures and high oxygen concentrations needed to form $NO_x$. Also, the flame temperature will be too low to form appreciable amounts of $NO_x$ by thermal reaction of $N_2$ with $O_2$.

CO, NOX EMISSION AFTER CO COMBUSTION

The flue gas going up the stack will have unusually low levels of both $NO_x$ and CO and may have unusually low oxygen levels as well. The $NO_x$ and CO levels should be below 100 ppm. Preferably $NO_x$ and CO are each below 50 ppm. Oxygen levels can be low because little CO combustion, in the conventional sense, is needed in the radiant section of the CO boiler, yet the flue gas is hot enough, typically above 1400° F. to permit efficient use of such oxygen as is added. The process tolerates operation of enough air to give 1 or 2 % oxygen in flue gas going up the stack, but this consumes a lot of energy in running the air blower and sends a lot of energy up the stack in the form of hot air. We believe satisfactory operation may be achieved with as little as 0.5 mole %, or even less than 0.2 mole % oxygen in the flue gas, discharged to the atmosphere.

CO/FUEL GAS RATIO

It is possible to operate the process of the present invention without any added fuel for the CO boiler at one extreme, and with almost no CO in the FCC regenerator flue gas at another extreme. Even though it is possible to operate without any fuel gas added, many operators will prefer to add modest amounts of fuel gas just to help stabilize combustion and ensure that the CO boiler will continue to operate despite any upsets that may occur in the FCC unit.

The low fuel gas case will be considered first. Flue gas temperatures will rise about 110° F. for each 1 vol % CO in combusted. Many FCC regenerators run at temperatures (flue gas leaving the final stage of cyclone equipment) of 1250° to 1400° F, so operation with 8 or 9 mole % CO, perhaps with some or extensive air preheat, will achieve the temperatures needed in the high temperature zone.

For a flue gas with about 8 mole % CO, at a temperature of about 1400° F., with combustion air preheated to a high temperature (which will be difficult to do) the adiabatic flame temperature will be about 2450° F.

For a flue gas with about 9 mole % CO, starting at 1300° F, the adiabatic flame temperature will be about 2480° F., which is just barely enough to be within a good operating range for a reasonable gas residence time, on the order of about 1 second.

Thus a regenerator flue gas with large amounts of CO can burn in the high temperature, or $NO_x$ conversion zone, to form the temperatures need for $NO_x$ conversion, with little or no fuel gas added.

High fuel gas cases will now be considered. If the FCC regenerator produces little CO, i.e., is in almost complete CO combustion mode but still contains 1 or 2% CO, then large amounts of fuel gas will be needed to achieve the desired $NO_x$conversion temperature. Large amounts of fuel gas may be needed even when the flue gas contains 6% CO, if the flue gas is not hot and/or air preheat is not available for the CO boiler.

An FCC regenerator flue gas with 6 mole % CO, at 1050° F., (a common temperature downstream of refiners with power recovery units, or turbine expanders), with fuel gas and added air supplied at 100° F. will require 8.7 moles of methane and 102 moles of air per 100 moles of FCC fluegas to produce a target flame temperature of 2800° F. In this case the fuel gas supplies about 80% of the heat needed to reach 2800° F. In many refineries significant amounts of fuel gas will be needed. This will be easy to cost justify if high pressure steam is valuable and/or fuel gas or some other fuel source is cheap.

DISCUSSION

The process of the present invention can be readily used in existing bubbling bed or fast fluidized bed FCC regenerators with only minor hardware changes. A CO boiler will be needed, but many FCC units have these, or will be forced to add them to deal with heavier feeds.

The process works well because we convert most of the $NO_x$and its precursors in the high temperature zone at conditions which are substoichiometric or approach stoichiometric. We take advantage of thermodynamics, which indicates that the equilibrium concentrations of both $NO_x$ and reduced species go towards zero in the presence of a stoichiometric amount of oxygen. We accelerate the rates of all relevant reactions so the system approaches equilibrium in the high temperature zone. This also removes most of the CO. The low temperature zone removes the last traces of CO, but at a lower temperature, from a flue gas with such a low heating value that neither nitrogen fixation nor high flame temperatures occur.

The process of the present invention will effectively reduce $NO_x$. Although there will be a large capital expense involved in building the high temperature section, this section will produce large amounts of high pressure steam which can be used to generate electricity or drive equipment in the refinery, and effectively offset the construction cost and the cost of any added fuel gas.

Our process does not require adding ammonia or urea or similar compounds which create the potential of a discharge of hazardous or nuisance materials. Instead, the process seems to rely on a variety of $NO_x$ precursors inherently generated in an FCC regenerator operating in partial CO burn mode, such as modest amounts of HCN and $NH_3$.

Our process does not require any catalyst, and can tolerate the presence of large amounts of catalyst and fines which would plug many catalytic approaches to $NO_x$ control.

We claim

1. A process for the catalytic cracking of a nitrogen containing hydrocarbon feed to lighter products comprising:

a. cracking said feed by contact a with supply of regenerated cracking catalyst in a fluidized catalytic cracking (FCC) reactor means operating at catalytic cracking conditions to produce a mixture of cracked products and spent cracking catalyst containing coke and nitrogen compounds;

b. separating cracked products from said spent cracking catalyst to produce a cracked product vapor phase which is charged to a fractionation means and a spent catalyst phase;

c. stripping spent catalyst in a stripping means to produce stripped, spent catalyst containing coke and nitrogen compounds;

d. regenerating stripped, spent catalyst in a catalyst regeneration means by contact with oxygen or an oxygen-containing regeneration gas at catalyst regeneration conditions to produce regenerated catalyst and flue gas containing:
less than 1.0 mole % oxygen;
at least 7 mole % CO; and
$NO_x$ and $NO_x$ precursors;

e. recovering from said catalyst regeneration means regenerated catalyst and recycling it to said crack reactor;

f. adding oxygen or an oxygen containing gas to said regenerator flue gas in an amount sufficient to produce a temperature rise of at least 750° F. and convert from about 50 to 100% of the CO in said flue gas to $CO_2$ and form a flue gas and oxygen mixture;

g. converting said $NO_x$ and $NO_x$precursors in $NO_x$ conversion zone operating at a $NO_x$ and $NO_x$ precursor conversion conditions including a temperature above 2200° F. and a residence time sufficient to convert at least a majority of said $NO_x$ and $NO_x$ precursors to nitrogen in said $NO_x$ conversion zone and convert at least a majority but not all of said CO to $CO_2$ in said zone to produce a $NO_x$ and $NO_x$ precursor depleted gas mixture having a temperature above 2200° F. and containing CO;

h. cooling said depleted mixture below 1800° F. to produce a cooled flue gas stream containing CO;

i. adding oxygen or an oxygen containing gas to said cooled flue gas stream in an amount sufficient to convert all of the CO contained in said cooled flue gas stream to $CO_2$ and converting CO to $CO_2$ in a CO conversion zone operating at temperature below 1800° F. to produce a flue gas stream which may be discharged to the atmosphere.

2. The process of claim 1 wherein the $NO_x$ conversion zone temperature is at least 2250° F.

3. The process of claim 1 wherein the $NO_x$ conversion zone temperature is 2400°to 2800° F.

4. The process of claim 1 wherein the CO conversion zone temperature is below 1700° F.

5. The process of claim 1 wherein the CO conversion zone temperature is below 1600° F.

6. The process of claim 1 wherein the CO conversion zone temperature is 1450°–1575°F.

7. The process of claim 1 wherein from 80 to 100% of the amount of oxygen or oxygen containing gas required by stoichiometry to convert CO in regenerator flue gas is added upstream of said $NO_x$ conversion zone.

8. The process of claim 1 wherein additional fuel is added to the regenerator flue gas upstream of or in said $NO_x$ conversion zone.

9. The process of claim 1 wherein an oxygen analyzer controller measures the oxygen content of gas discharged from said $NO_x$ conversion zone and controls the amount of oxygen or oxygen containing gas added to flue gas upstream of said $NO_x$ conversion zone.

10. The process of claim 9 wherein a solid-state oxygen sensor is used to measure oxygen content.

11. The process of claim 1 wherein the $NO_x$ conversion zone operates at a temperature of at least 2300 for a residence time of 0.1 to 10 seconds and said time and temperature are sufficient to convert at least 90% of the $NO_x$ and $NO_x$ precursors in said regenerator flue gas to nitrogen, and produce a flue gas containing less than 1 more % CO.

12. The process of claim 11 wherein the CO conversion zone operates with at least stoichiometric air, and at least 90% of the entering CO is converted to $CO_2$, and wherein air addition is limited to produce a CO conversion zone effluent gas containing less than 0.5 mole % CO.

13. The process of claim 1 wherein the gas stream which is discharged from the stack to the temperature contains:
less than 100 ppm CO;
less than 50 ppm $NO_x$; and
less than 0.5 mole % oxygen.

14. The process of claim 1 wherein the regenerator is a bubbling dense bed regenerator operating at a regenerator bed temperature of 1175°to 1400° F.

15. The process of claim 1 wherein the regenerator is a high efficiency regenerator having a fast fluidized bed coke combustor and produce regenerated catalyst having a

16. A process for the catalytic cracking of a nitrogen containing hydrocarbon feed to lighter products comprising:

a. cracking said feed by contact with a supply of regenerated cracking catalyst in a fluidized catalytic cracking (FCC) reactor means operating at catalytic cracking conditions to produce a mixture of cracked products and spent cracking catalyst containing coke and nitrogen compounds;

b. separating cracked products from said spent cracking catalyst to produce a cracked product vapor phase which is charged to a fractionation means and a spent catalyst phase;

c. stripping spent catalyst in a stripping means to produce stripped spent catalyst containing coke and nitrogen compounds;

d. regenerating stripped, spent catalyst in a catalyst regeneration means by contact with oxygen or oxygen-containing gas at catalyst regeneration conditions to produce regenerated catalyst and an FCC regenerator flue gas stream containing:
less than 0.1 mole % oxygen;
at least 3.0 mole % CO; and
$NO_x$ and $NO_x$ precursor including HCN in an amount so that if said regenerator flue gas were burned in a conventional CO boiler at 1400°–2000° F. in an oxidizing atmosphere it would produce a CO boiler flue gas containing more than 100 ppmv $NO_x$;

e. recovering from said catalyst regeneration means regenerated catalyst and recycling same to said cracking reactor;

f. adding oxygen or an oxygen containing gas to said regenerator flue gas in an amount sufficient to produce a temperature rise of at least 750° F. and convert from 60 to 100% of the CO in said flue gas to $CO_2$ and form a flue gas and oxygen mixture;

g. converting said $NO_x$ and $NO_x$ precursors in a $NO_x$-conversion zone operating at a $NO_x$ and $NO_x$ precursor conversion conditions including a temperature above 2400° F. and a residence time sufficient to convert at least a majority of said $NO_x$ and $NO_x$ precursors to nitrogen in said $NO_x$ conversion zone and convert at least a majority but not all of said CO to $CO_2$ in said zone to produce a $NO_x$ and $NO_x$ precursor depleted gas mixture having a temperature above 2400° F. and containing CO;

h. cooling said depleted mixture to a temperature below 1800° F. to produce a cooled flue gas stream containing CO;

i. adding oxygen or an oxygen containing gas to said cooled flue gas stream in an amount sufficient to convert all of the CO contained in said cooled flue gas stream to $CO_2$ and converting CO to $CO_2$ in a CO conversion zone operating at a temperature below 1800° F. to produce a flue gas stream containing less than 50 ppmv $No_x$ and less than 100 ppmv CO which may be discharged to the atmosphere.

17. The process of claim 16 wherein the $NO_x$ conversion zone temperature is 2400°to 2900° F.

18. The process of claim 16 wherein the CO conversion zone temperature is below 1700° F.

19. The process of claim 16 wherein the CO conversion zone temperature is 1450°–1575° F.

* * * * *